US005829420A

United States Patent [19]

Kita et al.

[11] Patent Number: 5,829,420

[45] Date of Patent: Nov. 3, 1998

[54] ELECTROMAGNETIC DEVICE FOR THE MAGNETIC TREATMENT OF FUEL

[75] Inventors: Ronald J. Kita, Doylestown; Peter A. Kulish, New Hope, both of Pa.

[73] Assignee: The Magnetizer Group, Inc., Fountainville, Pa.

[21] Appl. No.: 732,184

[22] Filed: Oct. 17, 1996

Related U.S. Application Data

[60] Provisional application No. 60/005,568 Oct. 18, 1995.

[51] Int. Cl.[6] ..... F23D 21/00

[52] U.S. Cl. ..... 123/538; 123/539

[58] Field of Search ..... 123/536, 537, 123/538, 539

[56] References Cited

U.S. PATENT DOCUMENTS

| | | | |
|---|---|---|---|
| 4,188,296 | 2/1980 | Fujitu | 210/222 |
| 4,308,847 | 1/1982 | Ruizzo, Jr. | 13/573 |
| 4,424,786 | 1/1984 | Imbert | 123/536 |
| 4,461,262 | 7/1984 | Chow | 123/539 |
| 4,572,145 | 2/1986 | Mitchell et al. | 123/538 |
| 4,711,271 | 12/1987 | Weisenbarger et al. | 137/827 |
| 5,124,045 | 6/1992 | Janczak et al. | 210/695 |
| 5,331,807 | 7/1994 | Hricak | 123/539 |
| 5,664,546 | 9/1997 | De Le Torre Barreiro | 123/538 |
| 5,671,719 | 9/1997 | Jeong | 123/538 |

*Primary Examiner*—Marguerite McMahon

*Attorney, Agent, or Firm*—Dann, Dorfman, Herrell and Skillman, P.C.

[57] ABSTRACT

A method and apparatus is disclosed for the magnetic treatment of a hydrocarbon fuel in order to achieve stoichiometric combustion. One embodiment consists of an emission sensing means, a microprocessor and electromagnet electrically inter-connected in feed back loop as to minimize the emission of carbon monoxide and unburned hydrocarbons while maximizing the output of carbon dioxide.

21 Claims, 2 Drawing Sheets

ELECTROMAGNETIC DEVICE FOR THE MAGNETIC TREATMENT OF FUEL

RELATED CASES

This application is a continuation in part of U.S. Provisional patent application Ser. No. 60/005,568, filed Oct. 18, 1995, which is incorporated herein by reference.

BACKGROUND ART

On Oct. 24, 1967, Saburo Mayato of Yokohama, Japan received U.S. Pat. No. 3,349,354 entitled: Means for Imposing Electric and Magnetic Fields on Flowing Fluids. The invention relates a magnetic device for treating hydrocarbon fuel flowing through a conduit through the simultaneous application of a magnetic field and an electric field. The device consists basically of a tubular section of conduit surrounded by permanent magnets and insulated in such a fashion that an electric current can be induced into the flowing fuel. The electron flow is induced coaxially with the flow of the fluid and is parallel with the magnetic flux emanating from a series of permanent magnets. The application of a voltage from an outside source such as an automotive lead-acid battery proved the source of the electromotive force. The net effect of the device was to subject the fuel to a series of magnetic forces in the presence of an electrostatic field. The loss of electrons generated by such an arrangement of field results in positive-charged ions that unbalances the normal balanced alkane group fuel molecules which results in greater reactivity of an inherently stable fuel molecule.

Another device of magnetic conditioning invented by Harley Adams, U.S. Pat. No. 4,508,901, of AZ Industries relates a magnetic device that is comprised of a series of permanent bar magnets arranged into a triangular shaped conduit. According to the theory espoused by the inventor: Electrons are magnets and according to Quantum Physics, they have a definite value, the Bohr Magneton. Chemical elements formed from electrons consequently are surrounded by weak magnetic fields. In liquid hydrocarbon fuels, these weak magnetic forces, van der Waals forces that are effective at holding intermolecular dimensions which pull long and branch chain fuel molecules together. Through the action of van der Waals forces, the fuel molecules form entanglements and the application of an external magnetic field, these molecular associations can be disrupted to permit a more thorough oxidation of the fuel.

Numerous other devices possessing various combinations of orientations of permanent magnets have been invented. After years of research into this field, various parameters have effected the performance of these devices. For example, the rate of fuel flow is a critical factor since the emf induced into the flowing fluid is basically determined by the equation $E=B\times V$, where B is the flux and V is the velocity of the fluid flowing through the conduit. With the use of permanent magnets, the flux is constant with respect to a fuel velocity that is variable. This is especially true of gasoline automotive engines where the fuel demand is subject to continual velocity changes as the mechanical load requirements of the engine changes. In some cases, the application of an intense magnetic field to a hydrocarbon fuel can result in decreased combustion efficiency as manifested by increased unburned hydrocarbons or carbon monoxide.

Peter Kulish, inventor of this invention, developed an Apparatus for the Magnetic Treatment of Liquids, U.S. Pat. No. 4,605,498 in 1986. The device was unique in that it exposed one field of a permanent magnet to fluids, such as gasoline. The application of such a field resulted in formerly improperly combusted fuels being properly combusted at nearer stoichiometric parameters. At stoichiometric parameters, harmful emissions such as carbon monoxide and unburned hydrocarbons are minimized. Also, the greatest thermal efficiencies for automobiles, furnaces and other combustion equipment are realized when fuels are oxidized at stoichiometric proportions. While the aforementioned invention was successful in bringing the combustion process nearer to the stoichiometric ideal, there were other factors that in some cases prevented the ideal from being achieved. Some of the variations in performance was caused by fuel chemical composition, fuel velocity through the magnetic field, temperature of the permanent magnetic material, and the like. While the aforementioned prior patent was successful in reducing emissions and thereby improving fuel economy, the installation of the unit was quite critical and in many cases required an experienced technician to achieve proper installation, since the composition of the pipe, as well as the distance from the combustion process were also of extreme importance.

The main object of the invention is to provide an electromagnetic device for the treatment of fluids which has the advantage of adjusting the magnetic field strength through the aid of a microprocessor which monitors fuel velocity, exhaust emissions, as well as other parameters of combustion in order to achieve stoichiometric combustion of the fuel.

The further object of the invention is to provide a magnetic treatment device to enhance the combustion of fuels that will provide optimal performance without the need of a skilled technician to install such a device.

Other advantages and applications of the invention will become apparent from the following description when read in conjunction with the accompanying drawings.

SUMMARY OF THE INVENTION

In order to achieve an ideal or stoichiometric combustion of fuel, it is necessary to subject the flowing fuel to a magnetic field that varies in response to changes in parameters such as: fuel flow rate, di-electrical properties of the fuel as well as gas emissions. Ideal combustion usually maximizes carbon dioxide and water output while keeping unburned hydrocarbons, oxides of nitrogen and carbon monoxide at a minimum. Heretofore, magnetic treatment devices that relied upon permanent magnets could not adjust the field for the aforementioned variables encountered in normal combustion.

To achieve optimal thermal output from a fuel enhanced by magnetic fields, it is necessary to integrate such variables as: fuel flow, chemical properties of the fuel, as well as the combustive emissions by means of a microprocessor control circuit as to adjust the magnetic field intensity of an electromagnet that impinges its flux on a hydrocarbon or hydrogen fuel flowing through a conduit.

Considerations must be made to the composition of the fuel, since there is no specific formula for gasoline, diesel fuels of heating fuels. These fuels are blends of aromatics, olefins and saturates. Benzene, an aromatic ingredient of liquid hydrocarbon fuels, according to the Magnetic Rotary Power Index of Physics and Chemistry, relates the high magnetic response of aromatics as well as other hydrocarbon fuel components. Benzene, $C_6H_6$, has an optical rotations of 11.27 when subjected to a magnetic field. The rotation of the molecule is indexed relative to water. Hexane, $C_6H_{14}$, a major component of hydrocarbon fuels, has an index of 6.62, or about twice the rotation of the previously cited aromatic. This is due to the electron path as it transverses the benzene ring. Consequently, the diamagnetic susceptibility of the organic molecule is quite high. According to the formula, benzene is composed of six carbon and six hydrogen atoms arranged in a hexagonal ring instead of the electrons pursuing their normal circular orbits within the atom, they wander completely around the ring. Since the contribution of an electron to the diamagnetic susceptibility is proportional to the square of the obit, the value of $r^2$ for a benzene ring is greater than the normal circular orbit. Consequently the diamagnetism is very large. The magnitude of the diamagnetic effect depends on the orientation of the ring with respect to the field that is applied. The maximum effect is achieved when the flux applied is perpendicular to the face of the ring and minimum when the face of the ring parallels the magnetic flux.

It also should be noted that the diamagnetic properties of fuel determines the de-clustering of the associated fuel complexes. When a magnetic field is applied to a diamagnetic substance, the net effect causes flux lines to diverge as the force is transmitted through the fluid causing the fuel molecule grouping to de-cluster. This is in contrast to para-magnetic material which causes the flux lines to converge when a magnetic field is applied.

While de-clustering effects are important in increasing the combustibility of a fuel, other effects also take place. Ruskin, in U.S. Pat. No. 3,228,868, relates the conversion of para-hydrogen into ortho-hydrogen through the application of a magnetic field. It should be noted that ortho-hydrogen and hydrogen have different properties due to relative orientation of the spin of the molecule. In para-hydrogen, the spins of the atom are opposite one another, while with ortho-hydrogen, the atomic spins are coincident. This renders ortho-hydrogen more unstable. By changing the orientation of the fuel molecules by magnetic means, it is therefore possible to alter combustibility.

With respect to magnetic treatment of fuel, it is necessary to subject the fuel to a specific magnetic intensity. The development of ferrite magnets served as one of the most cost effective means of magnetically treating fuel. When high energy product Neodymium Iron Boron magnets are applied to a fuel, a decrease in fuel mileage as related by increases in unburned hydrocarbons and carbon monoxide can result.

As related in magnetic viscosity reduction tests conducted by Lucas Fuel Systems of Acton, England, the window of optimal performance in the magnetic treatment of crude oil was only 500 gauss. Less magnetic intensity did not produce the desired magnetic viscosity reductions and higher levels were as effective as the lower level of magnetic stimulation. In other words, combustion efficiency decreases if the hydrocarbon fuel used in combustion is subjected to a magnetic field of intensity that is greater or less than an optimal range. Therefore, it is desirable to subject the hydrocarbon fuel to a magnetic field that is neither too high nor too low.

The viscosity of a fluid relates to its inter-molecular forces resisting deformation. As groups, or associations, of molecules are de-clustered, the viscosity decreases.

In order to improve the art of combustion through the use of magnetic means a system must be provided which can compensate for the variables encountered in the combustion process. Permanent magnets with their fixed power rating are not suitable candidates, hence electromagnets, or solenoids, governed through the use of a microprocessor feed-back system represents the best approach.

DESCRIPTION OF THE PREFERRED EMBODIMENT

The above cited FIGS. 1 to 4 relates a preferred embodiment of this invention. The diagrams and drawings showed an electromagnetic device suitable for the magnetic treatment of the constituents of combustion, namely, hydrocarbon fuel and oxygen. Liquid hydrocarbon fuels by their nature are diamagnetic. It is the diamagnetic properties of this fuel that permits a strong magnetic fields to de-cluster the groups of fuel molecules. The de-clustering of hydrocarbon fuel groups is desirable since de-clustering permits better atomization of the fuel, hence better combustion. Oxygen in contrast to fuel, is para-magnetic in nature and when subjected to a strong magnetic field, oxygen is drawn into the regions of denser magnetic flux. The para-magnetic properties of oxygen are not readily observable due to the invisible nature of gas, however, if a strong magnet is placed in a dewar containing liquid oxygen, the oxygen will adhere to the poles of the magnet in an observable fashion.

It is a goal of this invention to provide a magnetic means in order to obtain stoichiometric combustion through the operation of a magnetic field on a combustible fluid. The operation of a magnetic field on a liquid hydrocarbon fuel is to de-cluster the associated molecules to provide a more thorough combustion, while the operation of a magnetic field on air serves to separate and then concentrate the oxygen molecules, thus in a controlled situation can promote a more thorough combustion of the fuel.

Figure 1:
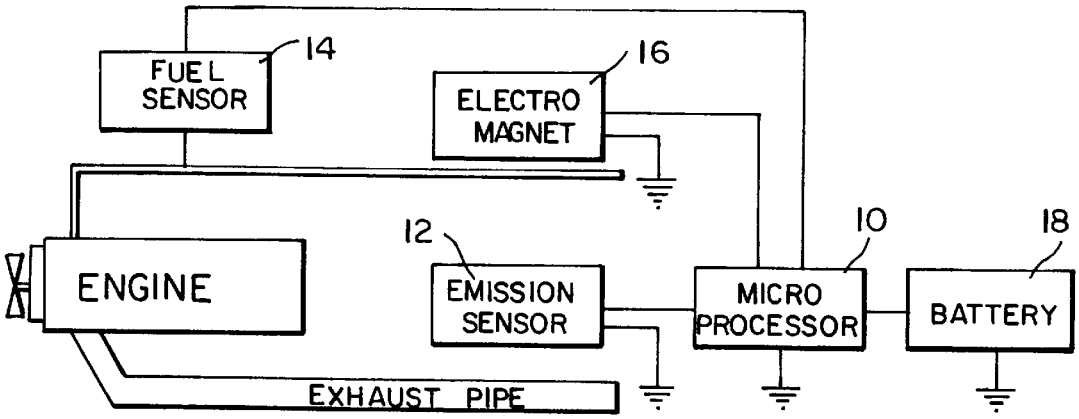
FIG. 1 shows a diagrammatic representation of a preferred embodiment of the device.

In FIG. 1, a block diagram is provided to show the interaction between the emission gas analyzer sensor, the microprocessor and the electromagnet.

Basically, the end products of combustion such as carbon monoxide, carbon dioxide and unburned hydrocarbons are monitored by placing the sensors in the exhaust pipe of an automotive engine. With an automobile engine, it is required that such sensors be placed in the exhaust stream prior to the catalytic converter, since mounting the sensor after the catalytic converter would not reflect the proper exhaust emissions. In FIG. 1, the block diagram relates the wiring schematic of the carbon monoxide, carbon dioxide and hydrocarbon sensor, microprocessor and the electromagnetic fuel treatment device. It should be noted that the carbon monoxide, carbon dioxide and hydrocarbon sensors can comprise one integral sensing unit.

The function of the microprocessor is to monitor the output of the emission sensor and respond by supplying the electromagnet with a proper level of electrical power. For example, the microprocessor is preferably set to control the magnetic intensity of the electromagnet so that the intensity is initially below the window of optimal performance combustion. An initial intensity of approximately 1500 to 1750 gauss should be below the window of optimal performance for most hydrocarbon fuels. If carbon monoxide levels are found in the exhaust stream by one of the exhaust sensors, the microprocessor increases the electrical power supplied to the electromagnetic device.

Power is increased to the electrical device until a reading of zero carbon monoxide is obtained. Upon the microprocessor receiving a reading of zero carbon monoxide, the electric power is maintained at this level. This insures continued stoichiometric combustion of the fuel. Alternatively, the power is increased until the carbon monoxide level begins to increase, at which point, it may be assumed that the magnetic intensity is above the window of optimal performance for combustion. The microprocessor then reduces the power to the electromagnet to correspond to the level at which the lowest level of carbon monoxide was detected by the sensor. Preferably, the determination that the magnetic intensity is above the window of optimal combustion is not made based on a single measurement. Instead, the microprocessor continues to incrementally increase the power to the electromagnet until the sensor indicates increasing carbon monoxide levels corresponding to a plurality of successive power level increments from the microprocessor. In this way, the microprocessor determines that the magnetic intensity is above the window for optimal combustion based on a pattern of increasing carbon monoxide levels rather than a single carbon monoxide level corresponding to a single electromagnetic intensity level.

In monitoring the parameters of stoichiometric combustion, the goal is to maximize the carbon dioxide output, while minimizing the output of carbon monoxide. While it requires two sensors to monitor CO and $CO_2$ production, stoichiometric combustion can be determined with the use of one sensor. If we know the composition of the hydrocarbon fuel, we can calculate the percentage of $CO_2$ output produced by stoichiometric conversion. For example, propane gas has an ultimate $CO_2$ percentage of 13.7%, while natural gas has only a 12.2 ultimate $CO_2$ percentage. Since gasoline represents a blend of various alkane hydrocarbons, the ultimate $CO_2$ percentage can be derived heuristically.

The goal of the multi-sensor monitoring is to provide electrical input to the microprocessor in order to minimize the production of certain exhaust gases such as nitrous oxide, carbon monoxide and unburned hydrocarbons, while maximizing the output of carbon dioxide. The meeting of the combustion parameters can be achieved by subjecting the fuel to a magnetic field as well as by subjecting the air to a magnetic field of proper intensity.

FIG. 1, an electrical schematic, shows the interrelationship of microprocessor 10, exhaust sensor 12, fuel sensor 14 and electromagnet 16. In order to achieve stoichiometric combustion of fuel, electrical inputs are fed from the exhaust sensor 12 and fuel sensor 14 into the microprocessor 10. The microprocessor 10 is programmed in such a manner as to minimize the exhaust gases such as carbon monoxide and oxides of nitrogen by subjecting an electromagnet 16 (mounted on the fuel line) to an appropriate level of electrical energization as determined by the integration of the output of the exhaust sensor 12 and fuel sensor 14. The function of the fuel sensor is to determine the nature of the hydrocarbon fuel. This can be achieved by monitoring the conductivity of the fuel or the di-electrical properties of the fuel. In such fashion it is possible to distinguish fuels ranging from alcohols to alkenes. It is necessary to distinguish such fuels since alcohols represent oxygenated fuels, for example: methanol, $CH_3OH$ while alkane based fuels such as octane, $C_8H_{18}$ contain no oxygen. This consideration plays an important role in the combustion of the fuel since it will affect the air/fuel ratio. In situations where hydrogen is combusted, the need for a fuel sensor is not required. The combustion of hydrogen basically produces only water when combusted, however, depending on the temperatures and pressures, oxides of nitrogen can be formed due to the nitrogen component of air. In such a situation, an exhaust sensor 12 would be required. The electrical signal from the exhaust sensor 12, which is capable of indicating the levels of oxides of nitrogen in the exhaust, would supply the microprocessor 10 with an electrical signal in order to provide the microprocessor with the requisite information to provide the electromagnet 16 with electrical power. The source of energy to power the microprocessor 10, electromagnet 16 and sensor can be availed through the use of a battery 18.

Figure 2:
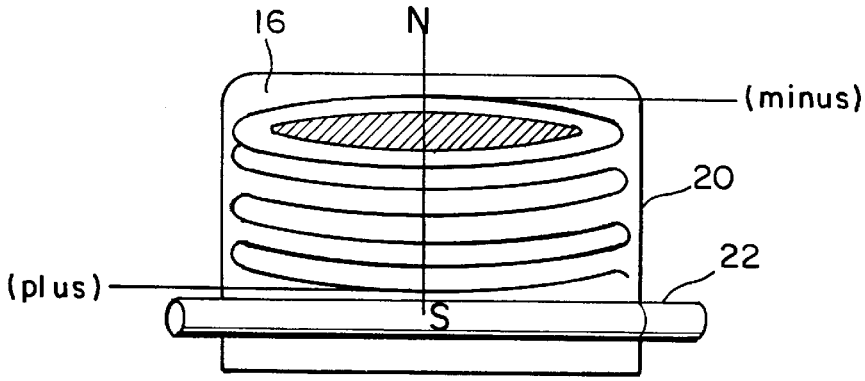
FIG. 2 shows an electromagnet coil for impinging one pole of the electromagnet on a conduit conducting fuel.

FIG. 2 shows an electromagnetic section of the device impinging one pole of the electromagnet 16 on a conduit conducting fuel from the fuel storage tank to the engine. In other words, the electromagnet is mounted adjacent the fuel line 22 so that one pole of the electromagnet is oriented toward the fuel line and the other pole is oriented away from the fuel line so that only one of the magnetic fields is generally directed into the fuel line and the other magnetic field is generally directed away from the conduit. Alternatively, the coil of the electromagnet can circumscribe the fuel line so that both poles of the electromagnet are adjacent the fuel line. In such a situation, the field would exist in a place coaxially with the flow of the fuel, and expose both the North and South field of the electromagnet to the fluid. Electromagnet 16 is encased in a housing 20 capable of supporting electromagnet 16. The fuel line 22 passes through the housing 20, and is made of a material that is permeable to the lines of flux generated by electromagnet 16 such as non-ferrous material.

Figure 3:
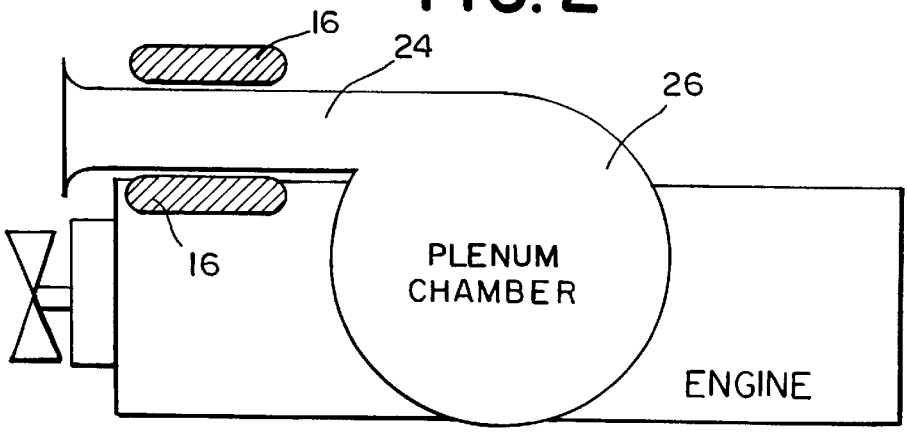
FIG. 3 relates an electromagnet placed on the exterior of an air induction horn.

Instead of mounting the electromagnet adjacent the fuel line, it may be desirable to mount the electromagnet adjacent an air duct 24 connected to the combustion chamber. FIG. 3 shows an electromagnetic air induction assembly consisting of an electromagnet 16, air duct 24 and plenum chamber 26. Air is drawn through air duct 24. Electromagnet 16 is suitably attached to the air duct 24 by an adhesive bond. Similarly, air duct 24 is attached to plenum chamber 26. Air flowing through air duct 24 is subjected to a magnetic field generated by the action of electromagnet 16. The intensity of the field is governed by electrical voltage supplied from the microprocessor. The intensity of the field is governed by the program of the microprocessor which seeks to minimize certain emissions such as carbon monoxide while maximizing carbon dioxide in a manner similar to the manner described above in connection with the electromagnetic mounted on the fuel line illustrated in FIGS. 1 and 2. The function of microprocessor 10 is to provide electromagnet 16 with sufficient electrical energy to achieve stoichiometric combustion. Also, it is desirable to have the microprocessor choose the proper direction of current flow through the electrical, since it has been found the magnetic stimulation of oxygen is sensitive to the proper pole impingement.

Figure 4:
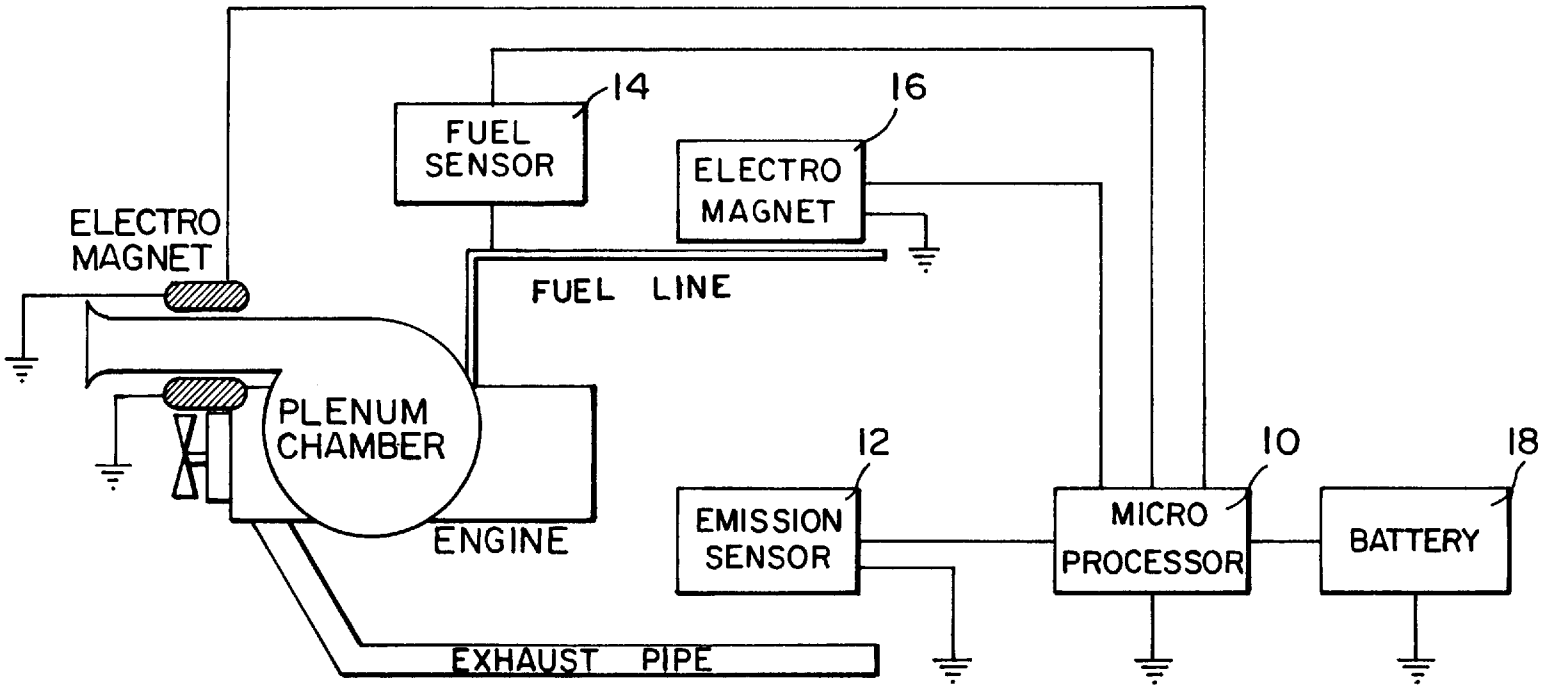
FIG. 4 relates a block diagram for the integration of information supplied from the sensors to the microprocessor to electrically energize an electromagnet mounted on the air induction assembly and fuel conduit.

FIG. 4 relates an electrical block diagram for subjecting an air and fuel conduit to a magnetic field through the energization of electromagnets with an emf regulated by a microprocessor in order to achieve stoichiometric combustion. The embodiment of FIG. 4 incorporates two separate electromagnets; one electromagnet 16A is mounted adjacent the fuel line, the second electromagnet 16B is mounted adjacent the air inlet. Both electromagnets are connected to the microprocessor, and controlled by the microprocessor. In response to the output from the emissions sensor 12, the microprocessor controls the magnetic intensity of both electromagnets to achieve optimal combustion. The microprocessor controls the magnetic intensity of the fuel line electromagnet 16A separately from the magnetic intensity of the air inlet electromagnet 16B because the proper magnetic intensity for each of the two electromagnets is not directly proportional. While the nitrogen component of air is non-reactive, the para-magnetic susceptibility of oxygen is quite high. Elements of the periodic chart are either para-magnetic or dia-magnetic with the exception of helium. Helium with its two electrons is not magnetically responsive. Within the para-magnetic group, there exists a special sub-class called ferro-magnetics. Ferro-magnetic materials are those para-magnetic elements that possess extraordinarily high magnetic susceptibilities. Elements of this group contain iron, nickel as well as oxygen.

It should therefore be understood that this invention is not limited to the particular embodiments described herein, but is intended to include all changes and modifications that are within the scope and spirit of the invention as set forth in the claims. For instance, the invention has been described in connection with a combustion chamber for an automobile. However, it should be readily apparent that the invention can be used with many different combustion chambers in which hydrocarbons are combusted, such as furnaces or boilers. In addition, rather than detecting the level of carbon monoxide, the exhaust sensor may be operable to sense the level of one of the elements of the other exhaust, such as carbon dioxide or oxygen.

We claim:

1. An apparatus for combusting fuels comprising:

a) a combustion chamber;

b) a fuel line connected to said combustion chamber for supplying fuel to the combustion chamber;

c) an exhaust outlet connected to said combustion chamber for receiving the exhaust from said combustion chamber;

d) an electromagnet adjacent to said fuel line having one pole oriented toward said fuel line and the other pole oriented-away from said fuel line;

e) an emissions sensor for sensing at least one of the elements of the combustion exhaust, and providing an output signal corresponding to the amount of the element sensed; and f) a controller connected to said emissions sensor for controlling the magnetic intensity of said electromagnet in response to the output signal from said emissions sensor.

2. The apparatus of claim 1 comprising a fuel sensor connected to said controller, said fuel sensor sensing the hydrocarbon composition of the fuel line and providing an outlet signal to said controller, wherein said controller controls the magnetic intensity of said electromagnet in response to the output from said emission sensor and said fuel sensor.

3. The apparatus of claim 1 wherein said controller comprises a microprocessor.

4. The apparatus of claim 1 wherein said controller controls the electromagnet to maintain the magnetic intensity of said electromagnet between 1500 and 2500 gauss.

5. The apparatus of claim 1 wherein said controller controls the electromagnet to maintain the magnetic intensity of said electromagnet between 1750 and 2250 gauss.

6. An apparatus for improving combustion efficiency, operable in connection with a combustion chamber having a fuel line for supplying fuel to the combustion chamber and an exhaust outlet for receiving the combustion exhaust produced from combustion in the combustion chamber, comprising:

a) an electromagnet adjacent the fuel line;

b) an emission sensor for sensing the amount of at least one of the elements of the combustion exhaust, and providing a signal corresponding to the amount of the element sensed; and c) a controller connected to said emissions sensor for controlling the magnetic intensity of said electromagnet in response to the signal from said emissions sensor.

7. The apparatus of claim 6 wherein an air inlet is connected to the combustion chamber and the apparatus comprises a second electromagnet mounted adjacent the air inlet, said second electromagnet being connected to said controller and said controller controlling the magnetic intensity of said second electromagnet in response to the signal received from said emissions sensor.

8. The apparatus of claim 6 wherein said electromagnet is mounted adjacent the fuel line so that one pole of the electromagnet is oriented toward the fuel line and the other pole is oriented away from the fuel line.

9. The apparatus of claim 6 wherein said controller controls the electromagnet to maintain the magnetic intensity of said electromagnet between 1500 and 2500 gauss.

10. The apparatus of claim 6 wherein said controller controls the electromagnet to maintain the magnetic intensity of said electromagnet between 1750 and 2250 gauss.

11. The apparatus of claim 6 comprising a fuel sensor connected to said controller, said fuel sensor sensing the hydrocarbon composition of the fuel in the fuel line and providing an outlet signal to said controller wherein said controller controls the magnetic intensity of said electromagnet in response to the output from said emission sensor and said fuel sensor.

12. A method for combusting fuels comprising the steps of:

a) providing a combustion chamber;

b) supplying fuel to the combustion chamber through a fuel line;

c) providing an exhaust outlet connected to said chamber for receiving the exhaust from said chamber;

d) mounting an electromagnet adjacent the fuel line so that one pole of the electromagnet is oriented toward the fuel line and the other pole is oriented away from the fuel line;

e) sensing the amount of at least one of the elements of combustion exhaust;

f) controlling the magnetic intensity of the electromagnet in response to the amount of exhaust element sensed.

13. The method of claim 12 comprising the step of sensing the hydrocarbon composition of the fuel in the fuel line and controlling the magnetic intensity of the electromagnet in response to the sensed hydrocarbon composition.

14. The method of claim 12 further comprising the step of controlling the electromagnet to maintain the magnetic intensity of the electromagnet between 1500 and 2500 gauss.

15. The method of claim 12 further comprising the step of controlling the electromagnet to maintain the magnetic intensity of the electromagnet between 1750 and 2250 gauss.

16. A method for improving combustion efficiency in a combustion chamber having a fuel line for supplying fuel to the combustion chamber and an exhaust outlet for receiving the combustion exhaust produced from combustion in the combustion chamber, comprising the steps of:

a) providing an electromagnet adjacent the fuel line;

b) sensing the amount of at least one of the elements of the combustion exhaust; and c) controlling the magnet intensity of the electromagnet in response to the amount of the exhaust element sensed.

17. The method of claim 16 wherein an air inlet is connected to the combustion chamber, comprising the steps of providing a second electromagnet mounted adjacent the air inlet, and controlling the magnetic intensity of the second electromagnet in response to the amount of the element of the combustion exhaust sensed.

18. The method of claim 16 comprising the step of mounting the electromagnet adjacent the fuel line so that one pole of the electromagnet is oriented toward the fuel line and the other pole is oriented away from the fuel line.

19. The method of claim 16 further comprising the step of controlling the electromagnet to maintain the magnetic intensity of the electromagnet between 1500 and 2500 gauss.

20. The method of claim 16 further comprising the step of controlling the electromagnet to maintain the magnetic intensity of the electromagnet between 1750 and 2250 gauss.

21. An apparatus for improving combustion efficiency, operable in connection with a combustion chamber having an air inlet for supplying air to the combustion chamber and an exhaust outlet for receiving the combustion exhaust produced from combustion in the combustion chamber, comprising:

a) an electromagnet adjacent the air inlet;

b) an emissions sensor for sensing at least one of the elements in the combustion exhaust, and providing a signal corresponding to the amount of the element sensed;

c) a controller connected to said emissions sensor for controlling the magnetic intensity of said electromagnet in response to the signal from said emissions sensor.

* * * * *